US006621374B2

(12) United States Patent
Higgins et al.

(10) Patent No.: US 6,621,374 B2
(45) Date of Patent: Sep. 16, 2003

(54) SPLITTER/COMBINER USING ARTIFICIAL TRANSMISSION LINES, AND PARALLELED AMPLIFIER USING SAME

(75) Inventors: Thomas Patrick Higgins, Mount Laurel, NJ (US); Dana Jay Sturzebecher, Mullica, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 82 days.

(21) Appl. No.: 09/909,212

(22) Filed: Jul. 19, 2001

(65) Prior Publication Data

US 2003/0016096 A1 Jan. 23, 2003

(51) Int. Cl.[7] ..... H01P 5/12
(52) U.S. Cl. ..... 333/124; 333/131; 330/295
(58) Field of Search ..... 333/124, 131, 333/125, 117, 118, 119; 330/124 D, 295

(56) References Cited

U.S. PATENT DOCUMENTS 4,901,032 A * 2/1990 Komiak ..... 330/277
4,947,136 A * 8/1990 Helms ..... 330/54
5,055,795 A * 10/1991 Kasper et al. ..... 330/54
5,111,157 A * 5/1992 Komiak ..... 330/286
5,363,072 A * 11/1994 Sakamoto et al. ..... 333/125
5,726,605 A * 3/1998 Morse et al. ..... 330/295
5,955,926 A * 9/1999 Uda et al. ..... 330/295
6,005,442 A * 12/1999 Maeda et al. ..... 330/295
6,201,445 B1 * 3/2001 Morimoto et al. ..... 330/295

* cited by examiner

*Primary Examiner*—Robert Pascal
*Assistant Examiner*—Dean Takaoka
(74) *Attorney, Agent, or Firm*—Duane Morris LLP

(57) ABSTRACT

A power splitter/divider may be used with a paralleled amplifier. The power splitter/divider includes a common port and a distribution structure for distributing equal-amplitude samples of the applied signal from the common port to four cascades of artificial transmission lines. The impedances of the sections of artificial transmission line are stepped, in order to provide an impedance transformation between the individual ports and the impedance presented to the common port. When there are four cascades, each presents an impedance of 200 ohms to the common port, for operation in a 50-ohm system. Each artificial transmission line of each cascade includes at least two planar, spirally disposed elongated conductors, spaced to provide mutual coupling between turns. In at least some of the artificial transmission lines, discrete capacitors aid in forming pi sections of transmission line.

10 Claims, 7 Drawing Sheets

FREQUENCY 4.0 TO 20.0 GHz

SPLITTER/COMBINER USING ARTIFICIAL TRANSMISSION LINES, AND PARALLELED AMPLIFIER USING SAME

FIELD OF THE INVENTION

This invention relates to power division and combination, and more particularly to power divider/combiners usable at radio frequencies including microwave and millimeter-wave frequencies.

BACKGROUND OF THE INVENTION

Modern communications often require broad bandwidth transmissions in order to accommodate very high data rates. These transmissions are made using electromagnetic or light signals. Regardless of the form of the transmission, substantial electronic amplifier power is often required at the transmitting end of a transmission path. If the transmission is by way of electromagnetic transmission lines, the lines are subject to significant losses at the high frequencies implied by broad bandwidth, and reamplification may be required at various points along the path. If the transmission path includes free-space propagation from one antenna to another, the transmission losses can be significant, which requires significant transmitted power to maintain the received signal above ambient noise levels. The production of photonic signals by means of lasers or other optoelectric devices is subject to significant inefficiencies. All of the losses and inefficiencies, in turn, require that electronic power amplification be performed.

As solid-state devices have improved over the years, the amount of power which an individual solid-state device can produce within a given frequency band has increased. As a result, a power level at a given frequency band which at one time might have required the paralleled outputs of several solid-state devices may now require only one solid-state device. However, with each advance in the power-handling capability of solid-state devices, the requirements of power, frequency and bandwidth have also increased, so that there is continuing need for electronic power amplifiers. The higher frequency and bandwidth requirements, in turn, tend to make parasitic reactances more important, and to require that the structures of the amplifiers become smaller, notwithstanding that the power requirements are remain high. Thus, in this context, the term "power" means that more than one solid-state device is required to produce the total output power of the amplifier, regardless of the actual power level.

The paralleling of amplifiers is old in the art. For example, vacuum-tube audio amplifiers using push-pull output stages were common at one time, and continue to find niche applications. Cable-television and similar amplifiers operating in the frequency range from about 50 to about 220 MHz. using both simple paralleled stages and push-pull amplifier stages, have been in use for forty years, and are known in the art. Such cable television amplifiers were generally fabricated in the form of discrete-component assemblages on printed-circuit boards.

The paralleling of two amplification devices ordinarily requires the division of the signal to be amplified into two portions, application of each portion of the signal to be amplified to one of the two amplifier devices, and the combining of the amplified output signals from the two devices. In general, signal dividers and signal combiners are passive devices which use the same types of structure, so that a signal divider for use at a given frequency and power level can generally be used as a signal combiner, and similarly a signal combiner can generally be used as a signal divider, simply by reversing the input and output ports. Those skilled in the art know that the phasing of the signals to be combined must be made in such a manner as to prevent cancellation, and that phase can be controlled at any location between the division of the signal into two portions and the combining point.

Power division in the abovementioned cable television amplifiers was generally done in one of two ways, namely by a pair of resistive power dividers coupled to the signal source, with their taps coupled to the divided-signal utilizing apparatuses, or by a center-tapped hybrid transformer arrangement wound on a magnetic core, with the center tap coupled to the source and the ends of the windings coupled to the divided-power utilization devices. It is common, in such arrangements, to couple an isolation resistor across the divided-power ports. It should be noted that the resistive power divider is lossy, in that half of the signal power is wasted as heat in the resistors, so the less lossy center-tapped hybrid was used almost exclusively for power combining.

In the field of microwave power amplification, U.S. Pat. No. 4,701,716, issued Oct. 20, 1987 in the name of Poole describes a scheme for paralleling distributed amplifiers such as travelling-wave tubes in such a manner as to maximize the bandwidth of the resulting combined system. In the Poole arrangement, distributed microwave 3 dB hybrids in the form of coupled quarter-wave transmission lines are used for the power dividers and combiners. Such distributed transmission-line hybrid arrangements are well known in for use in microwave systems.

While paralleling two output devices can provide about a doubling of the amplifier output power for a given level of distortion, yet more power may be required for certain applications. For such higher-power applications, the paralleling of more than two devices may be required. U.S. Pat. No. 4,315,222, issued Feb. 9, 1982 to Saleh describes a power combiner arrangement in which the output power from a plurality of amplifier modules is combined at a single junction. Each amplifier is coupled to the junction by a transmission line having an electrical length of one quarter wavelength ($\lambda/4$) at a frequency within the operating frequency range. U.S. Pat. No. 4,755,769, issued Jul. 5, 1988 in the name of Katz describes a composite amplifier including four signal amplifiers. A four-way power divider divides the signal to be amplified into four equal-amplitude, equal-phase portions, and each of the portions is applied to the input port of one amplifier. The amplified output signals are combined at a combining port by way of a scheme using the impedance transformation attributes of quarter-wavelength transmission lines. While details of the power divider are not specified in the Katz patent, one possible scheme for four-way power division is an arrangement similar to his combining arrangement, namely a cascade of two stages of transmission-line segments, including a first stage of division into two signal portions, followed (in the direction of the flow of signal in such an amplifier) by a second stage of division into two parts of each of the two divided signals, for a total of four divided signals.

Power division and combination can be performed by simple connection of two or more load or source devices, respectively, to a common source or load, respectively. Such simple junction-type splitter/combiners suffer from the problem of impedance mismatch, which tends to cause a portion of the input signal power to be reflected rather than going to the output ports of the splitter/combiner. A paralleled power amplifier generally similar to the Katz paralleled amplifier is described in U.S. Pat. No. 4,780,685 issued Oct.

25, 1988 in the name of Ferguson. The Ferguson arrangement uses tapped transmission lines as impedance transformers to improve the impedance match between a common 50-ohm output transmission line and plural transmission lines combined at a combining node.

An arrangement for combining a large number of individual amplifier modules into a composite microwave amplifier is described in U.S. Pat. No. 4,641,106, issued Feb. 3, 1987 in the name of Belohoubek et al. In the Belohoubek arrangement, radial transmission lines with quarter-wavelength slots are used for the division of the signal to be amplified into plural portions, and also for combining of the amplified signals. The Belohoubek et al. arrangement includes isolation resistors coupled between each individual transmission path and the next.

Another arrangement for combining a large number of amplifiers is described in U.S. Pat. No. 4,965,530, issued Oct. 23, 1990 in the name of Katz. In the Katz '530 arrangement, the output ports of each paralleled amplifier are coupled to a common combining node by way of switched transmission lines and switched isolation resistors.

Improved paralleling arrangements are desired.

SUMMARY OF THE INVENTION

A power splitter/combiner according to an aspect of the invention, for dividing applied electromagnetic signals into plural substantially equal portions, includes a plurality, equal in number to the number of the substantially equal portions, of cascades of artificial transmission line sections. Each of the cascades includes an "input" port and an "output" port, with it being understood that the terms "input" and "output" are reversed when the splitter/combiner is operating as a combiner. Each of the cascades also includes at least a first section of artificial transmission line coupled its input port and has a node remote from the input port, and a last section of artificial transmission line connected to the output port and has a node remote from the output port. Each of the cascades includes a further coupling arrangement coupling the node of the first section of artificial transmission line to the node of the last section of artificial transmission line of that cascade. The further coupling arrangement may comprise one of (a) a simple connection of the node of the first section of artificial transmission line to the node of the last section of artificial transmission line, so that the cascade includes but two sections of artificial transmission line, and (b) at least an additional or further artificial transmission line including input and output nodes, where one of which nodes of the further artificial transmission line is connected to the node of the first section of artificial transmission line. An input coupling arrangement is coupled to the input ports of the plurality of cascades of artificial transmission lines, for coupling the input ports of the plurality of cascades in parallel to define a common port of the power splitter/combiner. The electromagnetic signals, if applied to the common port of the power splitter/combiner, divide in accordance with the impedances presented by the input ports of the cascades. Similarly, the individual electromagnetic signals from the cascades, if combined at the common port of the power splitter/combiner, combine in accordance with the impedances presented to the common port.

The power splitter/combiner also includes a plurality, equal in number to the number of stages of artificial transmission line cascaded in any one of the cascades of artificial transmission lines, of sets of equal-valued isolation resistors. One of the sets of equal-valued isolation resistors is coupled to the output ports of the cascades and to a node common to the one of the sets. One end of the resistors of each other set of the plurality of sets of equal-valued isolation resistors are coupled to a node common to that set The other ends of the resistors of each other one of the sets of equal-valued resistors are also coupled to the nodes of corresponding ones of the stages of the artificial transmission lines remote from the input port of that one of the cascade of artificial transmission lines in which the stages of the artificial transmission lines lie.

Each of the stages of artificial transmission line, in an advantageous manifestation of the invention, includes at least first and second planar spiral inductors overlying a ground plane. The first and second planar spiral inductors are electrically coupled in series, and at least one of the stages of artificial transmission line of each cascade further includes first, second and third discrete capacitors coupled to the ends of the spiral inductors. In a particular embodiment, each of the discrete capacitors is in the form of a capacitive metallization overlying the ground plane, and the splitter/combiner includes four cascades of artificial transmission lines.

In a particular embodiment of the splitter/combiner, the input coupling arrangement comprises a first pair of elongated transmission lines in the form of strip conductors overlying the ground plane, where each transmission line of the first pair of elongated transmission lines has a first predetermined length, and are coupled together at a first common node for receiving the electromagnetic signal. The input coupling arrangement also includes a second pair of elongated transmission lines, also in the form of strip conductors overlying the ground plane. Each transmission line of the second pair of elongated transmission lines has a second predetermined length different from the first predetermined length, and they are coupled together at a second common node. A transmission-line bridge couples the first common node of the first pair of transmission lines to the second common node of the second pair of transmission lines, to thereby define the common port of the splitter/combiner. Thus, electromagnetic energy applied to the common port of the splitter/combiner arrives at the first common node is also applied to the second common node.

In another avatar of the invention, a power splitter/combiner for dividing applied electromagnetic signals into plural substantially equal portions, or for combining plural electromagnetic signals, comprises first, second, third and fourth cascades of artificial transmission lines or artificial transmission line segments or sections. Each of the cascades of artificial transmission lines includes a cascade of first, second and third artificial transmission line sections. Each of the artificial transmission line sections defines first and second nodes, and, within any one of the cascades of artificial transmission line sections, the second node of the first artificial transmission line section is connected to the first node of the second artificial transmission line section, and the second node of the second artificial transmission line section is coupled to the first node of the third artificial transmission line section.

In one hypostasis of this other avatar, a power coupling arrangement includes a common port for, in one mode of operation, receiving the electromagnetic signals, and routing divided electromagnetic signals with substantially equal amplitude and phase to the first nodes of the first artificial transmission line sections of the first, second, third and fourth cascades of artificial transmission line sections. Each of the first, second and third artificial transmission line sections of any one of the first, second, third and fourth cascades of artificial transmission line sections includes first and second planar, spiral conductors overlying a ground plane, with a second end of the first planar, spiral conductor of any one of the artificial transmission line sections connected to a first end of the second planar, spiral conductor of the one of the artificial transmission line sections. As a result, a first end of the first planar, spiral conductor defines the first node of the one of the artificial transmission line segments, and a second end of the second planar, spiral conductor defines the second node of the one of the artificial transmission line segments.

This other avatar also includes first, second, and third sets of isolation resistors, each containing four isolation resistors. Each of the isolation resistors of the first set of isolation resistors has one end connected to a first common node, and the other end connected to the second node of one of the first artificial transmission line sections of the first, second, third and fourth cascades of artificial transmission line sections. Each of the isolation resistors of the second set of isolation resistors has one end connected to a second common node, and the other end connected to the second node of one of the second artificial transmission line sections of the first, second, third and fourth cascades of artificial transmission line sections. Each of the isolation resistors of the third set of isolation resistors has one end connected to a third common node, and the other end connected to the second node of one of the third artificial transmission line sections of the first, second, third and fourth cascades of artificial transmission line sections. These resistors may be in the form of a resistive material overlying the ground plane.

A composite amplifier according to another manifestation of the invention includes a first power splitter/combiner including a common port and a plurality of individual ports. The first power splitter/combiner has its common port coupled to receive electromagnetic signals which are to be divided into substantially equal-amplitude portions, and generates substantially equal-amplitude signal portions at each of the individual ports of the first power splitter/combiner. The composite amplifier also includes a plurality of amplifiers equal in number to the number of the plurality of individual ports of the first power splitter/combiner. Each of the plurality of amplifiers includes an output port, and also includes an input port coupled to a corresponding one of the individual ports of the first power splitter/combiner, for receiving at the input port of that amplifier one of the equal-amplitude signal portions. Each amplifier is for generating amplified signals at its output ports. A second power splitter/combiner includes a common port and the same plurality of individual ports. The second power splitter/combiner has each of its individual ports coupled to the output port of one of the amplifiers. The second power splitter/combiner is for combining the amplified signals to produce combined amplified signals at the common port of the second power splitter/combiner. At least one of the first and second power splitter/combiners includes (a) a plurality, equal in number to the plurality, of cascades of artificial transmission lines. Each of the cascades of artificial transmission lines includes an input port and an output port. Each of the cascades of artificial transmission lines also includes at least a first section of artificial transmission line coupled to the input port and has a node remote from the input port, and a last section of artificial transmission line connected to the output port and having a node remote from the output port. Each of the cascades of artificial transmission lines also includes a further coupling arrangement coupling the node of the first artificial transmission line to the node of the last artificial transmission lines. This further coupling arrangement may comprise one of (i) a simple connection of the node of the first section of artificial transmission line to the node of the last section of artificial transmission line and (ii) a further artificial transmission line including input and output nodes, one of which nodes of the further artificial transmission line is connected to the node of the first section of artificial transmission line. The one of the first and second power splitter/couplers also includes (b) an input coupling arrangement coupled to the input ports of the plurality of cascades of artificial transmission lines, for coupling the input ports of the plurality of cascades in parallel to define the common port of the power splitter/combiner. Thus, electromagnetic signals, if applied to the common port of the power splitter/combiner, divide in accordance with the impedances presented by the input ports of the cascades. The one of the first and second power splitter/couplers also includes (c) a plurality, equal in number to the number of stages of artificial transmission line cascaded in any one of the cascades of artificial transmission lines, of sets of equal-valued isolation resistors. One of the sets of equal-valued isolation resistors is coupled to the output ports of the cascades and to a node common to the one of the sets. The resistors of other ones of the plurality of sets of equal-valued isolation resistors are coupled to a node common to the specific other one of the plurality of sets of equal-value isolation resistors, and to those nodes of stages of the artificial transmission lines remote from the input port of that one of the cascade of artificial transmission lines in which the stages of the artificial transmission lines lie. Each of the stages of artificial transmission line, in one hypostasis of the composite amplifier, includes at least first and second planar spiral inductors overlying a ground plane. The first and second planar spiral inductors are electrically coupled in series, and at least one of the artificial transmission lines further including first, second and third discrete capacitors coupled to the spiral inductors. Finally, the one of the splitter/combiners also includes a coupling arrangement for coupling the output port of each of the cascades of artificial transmission lines to one of the individual ports of the splitter/combiner.

In one version of this manifestation, at least some of the discrete capacitors are in the form of a capacitive metallization overlying the ground plane, and separated therefrom by a layer of dielectric material.

A composite amplifier according to a particular manifestation of the invention includes a plurality of amplifiers, each having an input port and an output port, the amplifiers being physically arrayed in a side-by-side line fashion defining a bisector. A common input port is located on the bisector of the line of the array, on that side of the array on which the input ports of the amplifiers lie. A common output port is located on the bisector, on that side of the array on which the output ports of the amplifiers lie. A first conductor structure includes elongated equal-length conductor strips connected to each of the input ports of the amplifiers and to a common point adjacent the common input port, and electrically connected to the common input port. A second conductor structure includes an elongated equal-length conductor strips connected to each of the output ports of the amplifiers and to a common point adjacent the common output port, and electrically connected to the common output port.

DESCRIPTION OF THE INVENTION

Figure 1:
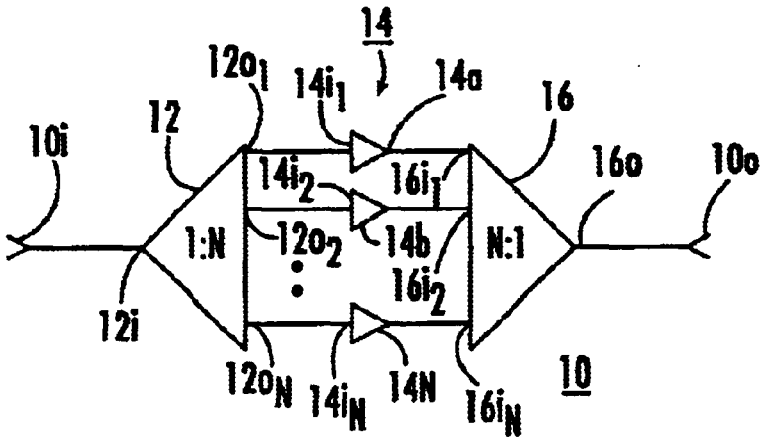
FIG. 1. PRIOR ART
FIG. 1 is a simplified block diagram of a paralleled or composite amplifier arrangement generally according to the prior art.

FIG. 1 is a simplified block diagram of a paralleled or composite amplifier 10 including an input port 10*i* at which electromagnetic signals to be amplified are received, and an output port 10*o* at which amplified signals are generated for use by a following utilization device, not illustrated. The amplifier 10 is used at what is generally referred to as radio frequencies (RF), which includes all frequencies above the so-called "audio" frequencies. In other words, the term radio frequencies includes all frequencies above about 20 KHz. More specifically, however, amplifier 10 is used at frequencies at and above which the distributed reactances of ordinary wire connections and electrical components tend to degrade amplifier performance. While this range is not specifically defined, amplifier 10 is used at frequencies above about 100 MHz to 1 GHz, and may, of course, be used at higher frequencies such as microwave and millimeter-wave frequencies.

The signals to be amplified are applied to input port 10*i* of amplifier 10 of FIG. 1, and flow to an input port 12*i* of a 1:N power divider or splitter 12, which divides the signal power into N portions, and produces substantially equal-amplitude signals at individual output ports $\mathbf{12}o_1$, $\mathbf{12}o_2$, . . . , $\mathbf{12}o_N$. Since power divider 12 contains no amplification, conservation of energy requires that the total power flowing out of the power divider must be no greater than the input power. In general, such power dividers are expected to produce the individual divided power signals at output ports $\mathbf{12}o_1$, $\mathbf{12}o_2$, . . . , $\mathbf{12}o_N$ with equal phase.

The equal-power, equal-phase divided signals produced by power divider 12 of FIG. 1 at individual output ports $\mathbf{12}o_1$, $\mathbf{12}o_2$, . . . , $\mathbf{12}o_n$ are individually applied to the input ports $\mathbf{14}i_1$, $\mathbf{14}i_2$, . . . , $\mathbf{14}i_N$ of the amplifiers 14*a*, 14*b*, . . . , 14N of a set 14 of amplifiers. Each amplifier of set 14 of amplifiers amplifies the signals applied to its input port, ideally with equal gain and phase, and ideally without distortion. The amplified signals produced by each amplifier of set 14 of amplifiers are coupled from the output port of the amplifier to a corresponding individual input port of a N:1 power combiner 16. More specifically, the amplified signal produced at the output port of amplifier 14*a* of FIG. 1 is applied to an input port $\mathbf{16}i_1$ of power combiner 16, the amplified signal produced at the output port of amplifier 14*b* is applied to an input port $\mathbf{16}i_2$ of power combiner 16, . . . , and the amplified signal produced at the output port of amplifier 14N is applied to an input port $\mathbf{16}i_N$ of power combiner 16. Power combiner 16 sums or adds the amplified signals applied to its input ports $\mathbf{16}i_1$, $\mathbf{16}i_2$, . . . , $\mathbf{16}i_N$, to produce a sum of amplified signals at its combined output port 16*o*, corresponding to the output 10*o* of composite amplifier 10. In those cases in which the phases of the signals arriving at the input ports of combiner 16 are not equal, compensating phase shifts are inserted into the various signal paths to provide power addition at output port 16*o* of power combiner 16.

Figure 2:
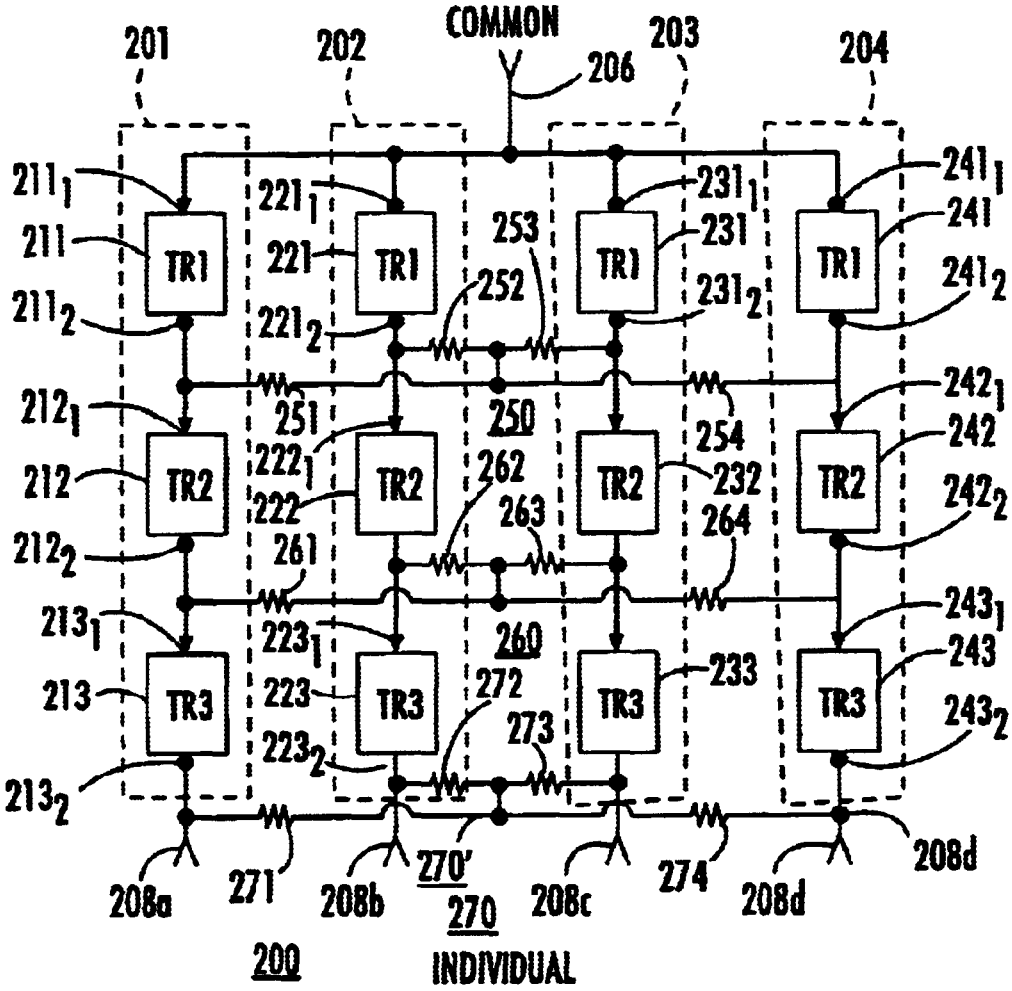
FIG. 2 is a simplified block diagram of a four-to-one splitter/combiner according to an aspect of the invention, which may be used in the arrangement of FIG. 1, including cascaded sections of artificial transmission lines.

FIG. 2 is a block diagram of a splitter/combiner 200, which can be used as either a power splitter or divider 12 or as a power combiner or summer 16 in the arrangement of FIG. 1. In FIG. 2, splitter or combiner (splitter/combiner) 200 has a common port 206 and individual output ports 208*a,* 208*b,* 208*c*, and 2082*d*. In operation as a signal splitter or divider, signals applied to the common port are divided into four parts, and each individual portion or part of the signal simultaneously appears at one of the four individual output ports, reduced in amplitude relative to the applied signal. In operation as a power combiner, coherent, in-phase signals simultaneously applied to the individual ports appear summed together at the common port, with increased amplitude relative to the individual signals.

The arrangement of splitter/combiner 200 of FIG. 2 includes a first cascade 201 of sections of artificial transmission line 211, 212, and 213, with a first node $\mathbf{211}_1$ of the first section of artificial transmission line (first artificial transmission line) connected to common port 206. Within cascade 201, a node $\mathbf{211}_2$ of artificial transmission line 211 is connected to the first node $\mathbf{212}_1$ of a second section 212 of artificial transmission line, and the second node $\mathbf{212}_2$ of the second section of artificial transmission line 212 is connected to the first node $\mathbf{213}_1$ of a third section of artificial transmission line 213, and the second node $\mathbf{213}_2$ of the third section of artificial transmission line has a second node $\mathbf{213}_2$, which is connected to or nominally the same as individual port 208*a*. The arrangement of splitter/combiner 200 of FIG. 2 also includes a second cascade 202 of sections of artificial transmission line 221, 222, and 223, with a first node $\mathbf{221}_1$ of the first section of artificial transmission line 221 connected to common port 206. Within cascade 202, a node $\mathbf{221}_2$ of artificial transmission line 221 is connected to the first node $\mathbf{222}_1$ of a second section 222 of artificial transmission line, and the second node $\mathbf{222}_2$ of the second section of artificial transmission line 222 is connected to the first node $\mathbf{223}_1$ of a third section of artificial transmission line 223, and the second node $\mathbf{223}_2$ of the third section of artificial transmission line has a second node $\mathbf{223}_2$, which is connected to or nominally the same as individual port 208*b*. The arrangement of splitter/combiner 200 of FIG. 2 also includes a third cascade 203 of sections of artificial transmission line 231, 232, and 233, with a first node $\mathbf{231}_1$ of the first section of artificial transmission line 231 connected to common port 206. Within cascade 203, a node $\mathbf{231}_2$ of artificial transmission line 231 is connected to the first node $\mathbf{232}_1$ of a second section 232 of artificial transmission line, and the second node $\mathbf{232}_2$ of the second section of artificial transmission line 232 is connected to the first node $\mathbf{233}_1$ of a third section of artificial transmission line 233, and the second node $\mathbf{233}_2$ of the third section of artificial transmission line has a second node $\mathbf{233}_2$, which is connected to or nominally the same as individual port 208*c*. Lastly, the arrangement of splitter/combiner 200 of FIG. 2 also includes a fourth cascade 204 of sections of artificial transmission line 241, 242, and 243, with a first node $\mathbf{241}_1$ of the first section of artificial transmission line 241 connected to common port 206. Within cascade 204, a node $\mathbf{241}_2$ of artificial transmission line 241 is connected to the first node $\mathbf{242}_1$ of a second section 242 of artificial transmission line, and the second node $\mathbf{242}_2$ of the second section of artificial transmission line 242 is connected to the first node $\mathbf{243}_1$ of a third section of artificial transmission line 243, and the second node $\mathbf{243}_2$ of the third section of artificial transmission line has a second node $\mathbf{243}_2$, which is connected to or nominally the same as individual port 208*d*. It should be understood that the splitter/combiner 200 illustrates four cascades of artificial transmission lines and is a 1:4 splitter or 4:1 combiner, but more or fewer cascades could be used for other splitting or combining ratios.

Also in FIG. 2, splitter/combiner 200 includes first, second and third sets of isolation resistors 250, 260, and 270, respectively, one for each stage of artificial transmission line within a cascade. Since there are first, second and third artificial transmission lines in each cascade, there are three sets of isolation resistors. The first set 250 of resistors includes four resistors 251, 252, 253, and 254, corresponding to one resistor for each of the four cascades 201, 202, 203, and 204. Each of the resistors of set 250 has one end connected to a floating node 250' and the other end connected to the second node of the first section of artificial transmission line in each cascade. More particularly, resistor 251 has one end connected to the floating node 250' and the other end connected to node $\mathbf{211}_2$ of section 211 of artificial transmission line within cascade 201, resistor 252 is connected at one end to floating node 250' and at the other end to node $\mathbf{221}_2$ of section 221 of artificial transmission line within cascade 202, resistor 253 is connected at one end to floating node 250' and at the other end to node $\mathbf{231}_2$ of section 231 of artificial transmission line in cascade 203, and resistor 254 is connected at one end to floating node 250' and at the other end to node $\mathbf{241}_2$ of section 241 of artificial transmission line in cascade 204.

Similarly, the second set 260 of resistors includes four resistors 261, 262, 263, and 264, corresponding to one resistor for each of the four cascades 201, 202, 203, and 204. Each of the resistors of set 260 has one end connected to a floating node 260' and the other end connected to the second node of the first section of artificial transmission line in each cascade. More particularly, resistor 261 has one end connected to the floating node 260' and the other end connected to node $\mathbf{212}_2$ of section 212 of artificial transmission line within cascade 201, resistor 262 is connected at one end to floating node 260' and at the other end to node $\mathbf{222}_2$ of section 222 of artificial transmission line within cascade 202, resistor 263 is connected at one end to floating node 260' and at the other end to node $\mathbf{232}_2$ of section 232 of artificial transmission line in cascade 203, and resistor 264 is connected at one end to floating node 260' and at the other end to node $\mathbf{242}_2$ of section 242 of artificial transmission line in cascade 204. Also, the third set 270 of resistors includes four resistors 271, 272, 273, and 274, corresponding to one resistor for each of the four cascades 201, 202, 203, and 204. Each of the resistors of set 270 has one end connected to a floating node 270' and the other end connected to the second node of the first section of artificial transmission line in each cascade. More particularly, resistor 271 has one end connected to the floating node 270' and the other end connected to node $\mathbf{213}_2$ of section 213 of artificial transmission line within cascade 201, resistor 272 is connected at one end to floating node 270' and at the other end to node $\mathbf{223}_2$ of section 223 of artificial transmission line within cascade 203, resistor 273 is connected at one end to floating node 270' and at the other end to node $\mathbf{233}_2$ of section 233 of artificial transmission line in cascade 203, and resistor 274 is connected at one end to floating node 270' and at the other end to node $\mathbf{243}_2$ of section 243 of artificial transmission line in cascade 204.

Figure 3A:
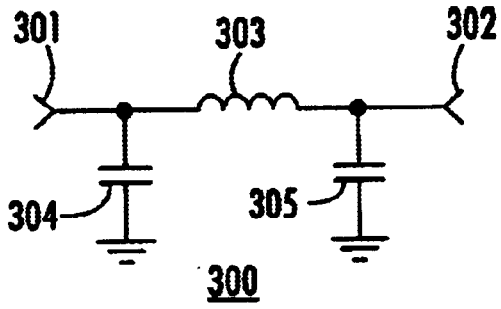
FIG. 3*a* is a simplified schematic diagram of a single pi segment of a section of artificial transmission line.
Figure 3B:
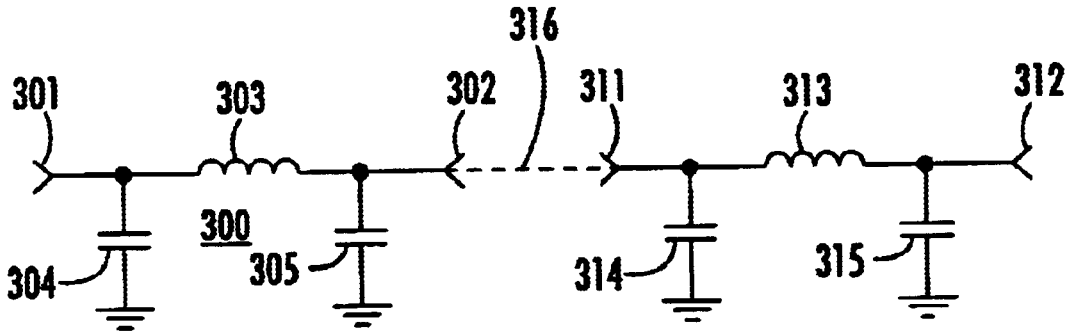
FIG. 3*b* illustrates the cascading of two segments such as that of FIG. 3*a,* and FIG. 3*c* illustrates a schematic representation of the result of the cascading of FIG. 3*b;*
Figure 3C:
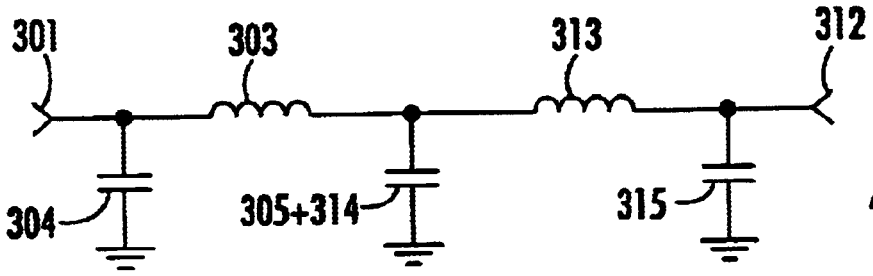

Each section of artificial transmission line of FIG. 2 consists of a cascade of transmission-line elements including series inductance and parallel capacitance. More specifically, each section of artificial transmission line consists of a plurality of "serially coupled" or cascaded pi segments of artificial transmission line, including a serially coupled inductor, and a capacitance or capacitor to ground from each end of the inductor, as illustrated in FIG. 3*a*. In FIG. 3*a*, a pi (Π) segment of artificial transmission line includes an inductor 303 serially coupled between segment ports 301 and 302, and a capacitor or capacitance 304 coupled between port 301 and reference potential or ground, and another capacitor or capacitance 305 coupled between port 305 and ground it should be noted that those skilled in the art realize that a port requires two conductors or connections, and that in the case of artificial transmission lines, one of the conductors is ground or some other reference potential. When two (or more) such pi segments of artificial transmission line are cascaded, the values of the capacitor or capacitance at the juncture combine to a greater value. This is illustrated in FIG. 3*b*, where the artificial transmission line segment 300 of FIG. 1*a* is illustrated together with a second similar segment 310, including an inductor 313 serially connected between ports 311 and 312, and with capacitors or capacitances 314 and 315 connected between ports the cascading is represented by a phantom conductor 316. It will be seen that capacitor or capacitance 305 is coupled in parallel with capacitor or capacitance 314, and their combined capacitance is therefore larger than that of either alone. However, in a schematic diagram such as FIG. 3*c* representing the two pi sections of FIG. 3*b*, only a single capacitor is illustrated, since a single capacitor or capacitance having a value equal to the sum of the capacitors or capacitances 305 and 314 is required. Thus, the schematic appearance of a cascade of segments of artificial transmission line may appear different from the anticipated result.

According to an aspect of the invention, the artificial transmission lines of each cascade 201, 202, 203, and 204 of FIG. 2 have differing characteristic or surge impedances, selected to provide a relatively low-reflection impedance transformation between the various ports. For example, if a 50-ohm characteristic impedance is desired at each of the common and individual ports 206 and 208*a*, 208*b*, 208*c*, and 208*d*, it will be apparent that the impedance presented to common port 206 by each of the first sections of artificial transmission lines 211, 222, 232, and 242 must be 200 ohms, so that their parallel combination, as seen from common port 206, is one-fourth of 200 ohms, or 50 ohms. Similarly, it will be apparent that the impedance presented by each of third sections of artificial transmission line 213, 223, 233, and 243 must be 50 ohms. Consequently, the characteristic impedances of the various sections must be selected to provide the desired impedances. Selection of the impedances of the sections of artificial transmission line in FIG. 2 is accomplished by selecting the values of the inductances and capacitors or capacitances of the various segments of the artificial transmission line. The impedance $Z_0$ of each pi segment of artificial transmission line is given by $$Z_0 = \left(\frac{L}{C}\right)^{\frac{1}{2}} \quad (1)$$

where L is the inductance of each series inductor in each pi section, and C is a capacitance equal to twice the value of either $$f_0 = \frac{1}{\pi Z_0 C} \quad (2)$$

capacitor of a single pi section. The cutoff frequency $f_0$ of such an artificial transmission line is The values selected must provide the desired impedance transformation and the desired frequency bandwidth. The cutoff frequency can be increased by decreasing the values of the inductors and capacitors or capacitances in the sections of artificial transmission line, and the bandwidth can be increased by adding stages of artificial transmission line in each cascade, as by, for example, using four stages of artificial transmission line rather than three in each cascade of FIG. 2.

The determination of the characteristic impedances of the various sections of artificial transmission line are described in *High Power GaAs FET Amplifiers* by John L. Walker, published by Artech House, Boston, Mass. 1993. In the particular three-stage embodiment described in conjunction with FIG. 2, where each stage of artificial transmission line includes two pi sections, for use in a 50-ohm environment, three representative sections 211, 212, and 213 of artificial transmission line have characteristic impedances of 120 ohms, 82 ohms, and 59 ohms, respectively. For operation in a frequency range of 4 to 20 GHz., the series inductors of section 211 have nominal inductance values of 0.88 nH, the series inductors of section 212 have nominal inductance values of 0.66 nH, and the series inductors of section 213 have nominal inductance values of 0.51 nH. It should be noted that these are ideal or calculated values, and the actual values of the inductors will be affected by unavoidable stray reactances. According to an aspect of the invention, each of the series inductances is in the form of an elongated strip conductor formed into planar spirals with a pitch sufficient to provide substantial coupling from turn to turn. Such structures are easy to make in microwave integrated circuits. In such microwave integrated circuits, the elongated conductor strip is coiled into a planar spiral, which overlies a dielectric substrate, which in turn may overlie a conductive ground plane. Such a spiral-wound conductor does not act like a corresponding length of non-coiled strip transmission line, for example in that the through delay is shorter than the delay of the equivalent length of conductor laid out in a straight line, presumably because of the internal coupling of energy between or among turns.

Figure 4:
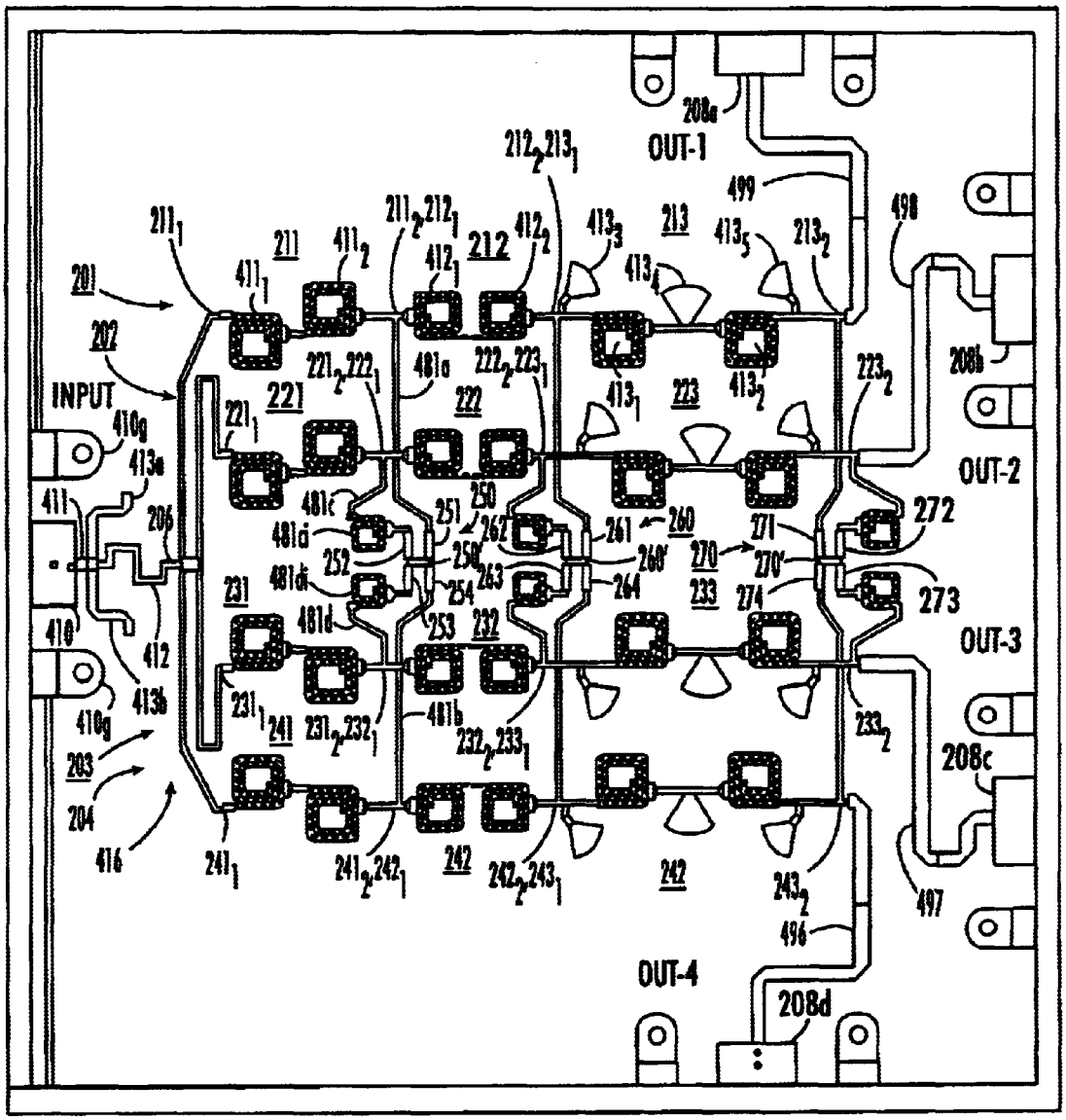
FIG. 4 illustrates a microcircuit layout embodying an aspect of the invention.

FIG. 4 is a plan view of the conductors on the circuit side of a microwave integrated circuit expressing the structure of splitter/combiner 200 of FIG. 2 in a physical layout. In FIG. 4, elements corresponding to those of FIG. 2 are designated by corresponding reference numerals. In FIG. 4, a metallization 410 represents a bonding pad to which a wire bond may be made to couple the combined port 206 to the outside world. The two metallizations 410*g* represent bonding pads for the ground associated with metallization 410. Looking at the structure of FIG. 4 as being a power splitter to ease the explanation, signal power applied to bonding pad 410 proceeds by way of a transmission line 411 and a further transmission line 412 to juncture 206, the "input" port of the splitter itself. A pair of open-circuited transmission-line structures 413*a* and 413*b* are connected to the juncture of transmission line sections 411 and 412 for impedance matching to account for the wire bond and other minor reactances. The common port 206 is connected to the input nodes $\mathbf{211}_1$, $\mathbf{221}_1$, $\mathbf{231}_1$, and $\mathbf{241}_1$ by a transmission-line structure designated generally as 416, which includes transmission lines of equal lengths extending from common port 206 to input nodes $\mathbf{211}_1$, $\mathbf{221}_1$, $\mathbf{231}_1$, and $\mathbf{241}_1$ to maintain constant phase at the input nodes.

In FIG. 4, the four cascades 201, 202, 203, and 204 are identified generally. Cascade 201 of sections of artificial transmission line includes artificial transmission line sections 211, 212, and 213, cascade 202 includes artificial transmission line sections 221, 222, 223, cascade 203 includes artificial transmission line sections 231, 232, 233, and cascade 204 includes artificial transmission line sections 241, 242, and 243. Artificial transmission line section 211 extends from node $\mathbf{211}_1$ to node $\mathbf{211}_2/\mathbf{212}_1$, artificial transmission line section 212 extends from node $\mathbf{211}_2/\mathbf{212}_1$ to node $\mathbf{212}_2/\mathbf{213}_2$.

Artificial transmission line section 213 is taken as typical of any of artificial transmission line sections 213, 223, 233, and 243. In FIG. 4, artificial transmission line section 213 includes a first planar, spiral-wound metallization $\mathbf{413}_1$ connected at one end to node $\mathbf{212}_2/\mathbf{213}_1$, and connected at its other end to one end of a second planar, spiral-wound metallization $\mathbf{413}_2$. Spiral-wound metallizations $\mathbf{413}_1$ and $\mathbf{413}_2$ are each about one turn. The second end of second planar, spiral-wound metallization $\mathbf{413}_2$ is connected at node $\mathbf{213}_2$ to metallization 208*a* by a 60-ohm transmission line 499. Artificial transmission line section 213 also includes a surface metallization capacitor $\mathbf{413}_3$ connected adjacent node $\mathbf{212}_2/\mathbf{213}_1$, a second surface metallization capacitor $\mathbf{413}_4$ connected to the junction of inductors $\mathbf{413}_1$ and $\mathbf{413}_2$, and a third surface metallization capacitor $\mathbf{413}_5$ connected to output node $\mathbf{213}_2$ of artificial transmission line section 213. It can be seen that the surface area of capacitor $\mathbf{413}_4$ is larger than the surface areas of either capacitor $\mathbf{413}_3$ or capacitor $\mathbf{413}_5$, as expected if the section of artificial transmission line 213 includes two pi segments. It will be understood that fringing fields contribute to the capacitance of each capacitor, and therefore the form factor of the capacitor surface, as well as the total area, affects the capacitance. Artificial transmission line sections 223, 233, and 234 are similar to section 213, and should need no further explanation except for noting that their output nodes $\mathbf{223}_2$, $\mathbf{233}_2$, and $\mathbf{243}_2$ are connected by way of 50-ohm transmission-line sections 498, 497, and 496, respectively, to their bonding pads 208*b*, 208*c*, and 208*d*, respectively.

Artificial transmission line section 212 is taken as representative of artificial transmission line sections 212, 222, 232, and 242. Transmission line section 212 extends from node $\mathbf{211}_2/\mathbf{212}_1$ to node $\mathbf{212}_2/\mathbf{213}_1$, and also includes two pi sections, although the capacitance cannot be visually discerned. However, the series-connected inductors are visible as $\mathbf{412}_1$ and $\mathbf{412}_2$, and can be seen to have about two turns. As a result of having about twice as many turns as either inductor $\mathbf{413}_1$ or $\mathbf{413}_2$, the inductances of inductors $\mathbf{412}_1$ and $\mathbf{412}_2$ is greater than those of inductors $\mathbf{413}_1$ or $\mathbf{413}_2$, notwithstanding their smaller diameter. Since the capacitance to define the cascaded pi sections are distributed or parasitic to the inductors, the capacitance values are much smaller than the capacitance values of discrete capacitors $\mathbf{413}_3$, $\mathbf{413}_4$, or $\mathbf{413}_5$ of section 213. As a result of the larger series inductances and smaller shunt capacitances than in section 213, artificial transmission line section 212 has a higher characteristic impedance than that of section 213.

Artificial transmission line section 211 is taken as representative of artificial transmission line sections 211, 221, 231, and 241. Transmission line section 211 extends from node $\mathbf{211}_1$ to node $\mathbf{211}_1$, and also includes two pi sections, although, as with section 212, the capacitance cannot be visually discerned. However, the series-connected inductors are visible as $\mathbf{411}_1$ and $\mathbf{411}_2$, and can be seen to have about two turns, but are larger than the inductors of section 212. As a result of having a larger diameter as either inductor $\mathbf{412}_1$ or $\mathbf{412}_2$, the inductances of inductors $\mathbf{411}_1$ and $\mathbf{411}_2$ are greater than those of inductors $\mathbf{412}_1$ or $\mathbf{412}_2$. The capacitance to define the cascaded pi sections are distributed or parasitic to the inductors $\mathbf{411}_1$ and $\mathbf{411}_2$, the capacitance values are much smaller than the capacitance values of discrete capacitors $\mathbf{413}_3$, $\mathbf{413}_4$, or $\mathbf{413}_5$ of section 213. At least as a result of the larger series inductances in section 211 relative to those in section 212, artificial transmission line section 211 has a higher characteristic impedance than that of section 212. As mentioned, the characteristic impedances of the three cascaded sections should be about 59, 82, and 120 ohms for the 4:1 splitter/combiner. Minor deviations from these values will merely affect the impedance match.

Isolation resistor set 250 is taken as typical of isolation resistor sets 250, 260, and 270. In FIG. 4, resistor 251 of set 250 is connected to a floating node 250' and, by a transmission line 481*a*, to junction $\mathbf{211}_2/\mathbf{212}_1$ at the juncture of sections 211 and 212 of artificial transmission line. Similarly, resistor 254 is connected to floating node 250' and, by way of a transmission line 481*b*, to junction $\mathbf{241}_2/\mathbf{242}_1$ at the juncture of sections 241 and 242 of artificial transmission line. It will be noted that transmission line sections 481*a* and 481*b* extend from the outermost cascades 201 and 204 to the center of the structure. Resistor 252 is connected to floating node 250' and, by way of a spiral inductor 481*ci* and a transmission line 481*c*, to junction $\mathbf{221}_2/\mathbf{222}_1$ at the juncture of sections 221 and 222 of artificial transmission line. Similarly, resistor 253 is connected to floating node 250' and, by way of a transmission line 481*d* and a spiral inductor 481*di*, to junction $\mathbf{231}_2/\mathbf{232}_1$ at the juncture of sections 231 and 232 of artificial transmission line. The presence of spiral inductors 481*ci* and 481*di* in series with transmission lines 481*c* and 481*d*, respectively, adjusts the lengths of transmission line associated with resistors 252 and 253 to be equal to that associated with resistors 251 and 252. It can be seen that if a spiral inductor were not used, it would be difficult to equalize the line lengths in series with resistors 251, 252, 253, and 254 without making the entire microwave integrated circuit 200 larger.

The artificial transmission line sections 211, 212, 213, 231, 232, 233, 241, 242, and 243 are each about one-quarter wavelength long near the center of the operating frequency band, or at about 9 GHz for a frequency band of 4 to 20 GHz.

It should be noted that transforming filters are sometimes used to provide impedance transformations, as described, for example, in the text "Electronic Circuit Analysis, Vol. 1, Passive Circuits" by Phillip Cutler, published by McGraw-Hill Co., 1960. Such filters provide impedance transformations which vary as a function of frequency, whereas an artificial transmission line provides an impedance transformation only at that frequency at which it has a length of one quarter wavelength (and odd multiples thereof).

Figure 5A:
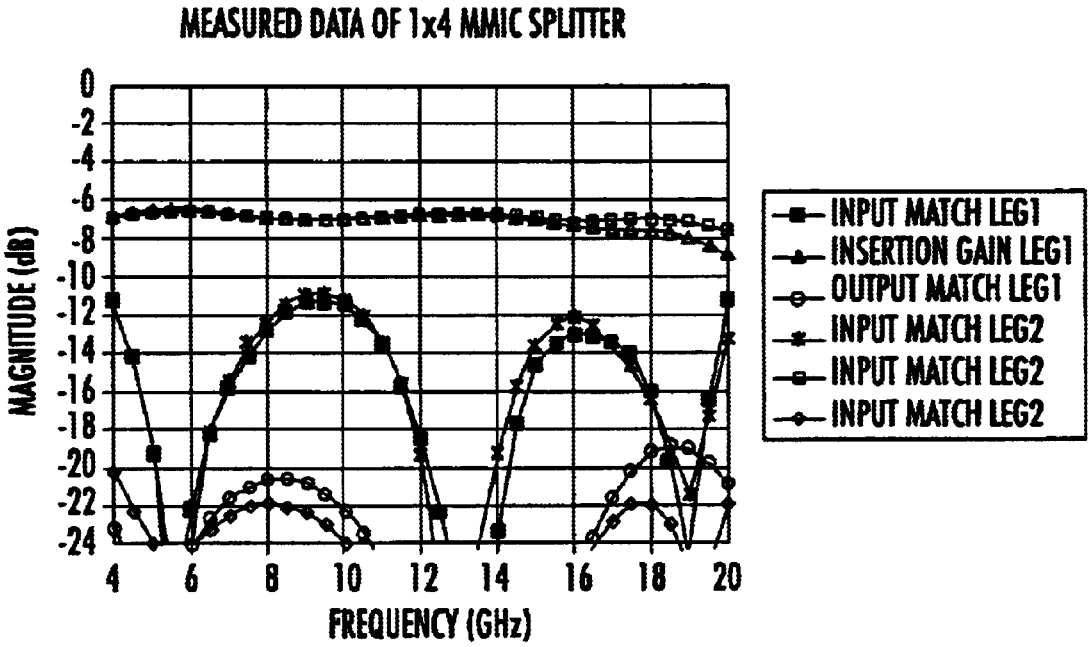
FIGS. 5*a* and 5*b* are plots representing the through loss and impedance match, and the phase, respectively, of the structure of FIG. 4.

FIG. 5*a* includes plots of through loss or magnitude in dB between the common port and two independent legs of the structure of FIG. 4, the other independent legs being assumed to be the same. The theoretical loss of a four-way power divider is 6 dB. As can be seen by reference to the plots with open square and open triangular symbols, the through loss is in the range of 6.5 dB over much of the frequency range of 4 to 20 GHz, increasing to somewhat at the high end of the range. FIG. 5*a* also includes plots of impedance match for the same two independent legs, and for the common port, given in terms of return loss in dB. The "input" of both legs is the common port, and the "output" of legs 1 and 2 are the individual ports. Thus, the plots with the asterisk symbol and the closed rectangular symbol represent the impedance match or return loss looking into the common port. In general, these plots overlap, especially at the left of FIG. 5*a,* where they rise to a high of about 11 dB. The impedance match looking into the "leg 1" individual port is designated by an open circle, and that of "leg 2" is designated by an open diamond. It can be seen that the match at the individual legs is better than 20 dB over most of the frequency range.

Figure 5B:
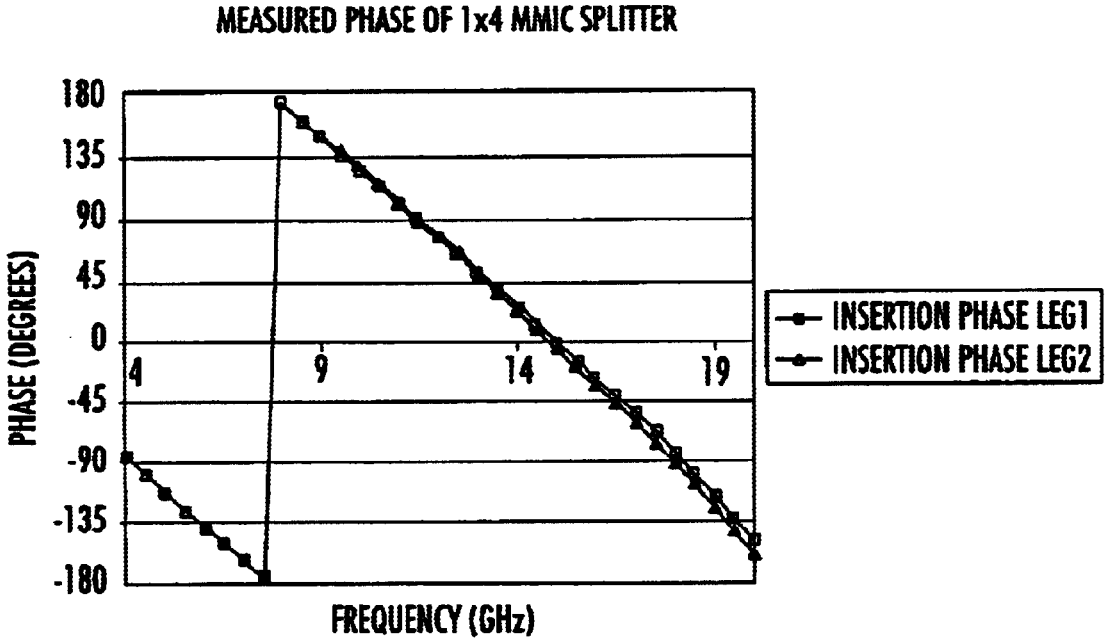

FIG. 5*b* illustrates the phase response of the structure of FIG. 4 over the same frequency range from the common port to two of the independent legs. As can be seen, the phase tracks well and is substantially linear over the frequency range of interest.

Figure 6:
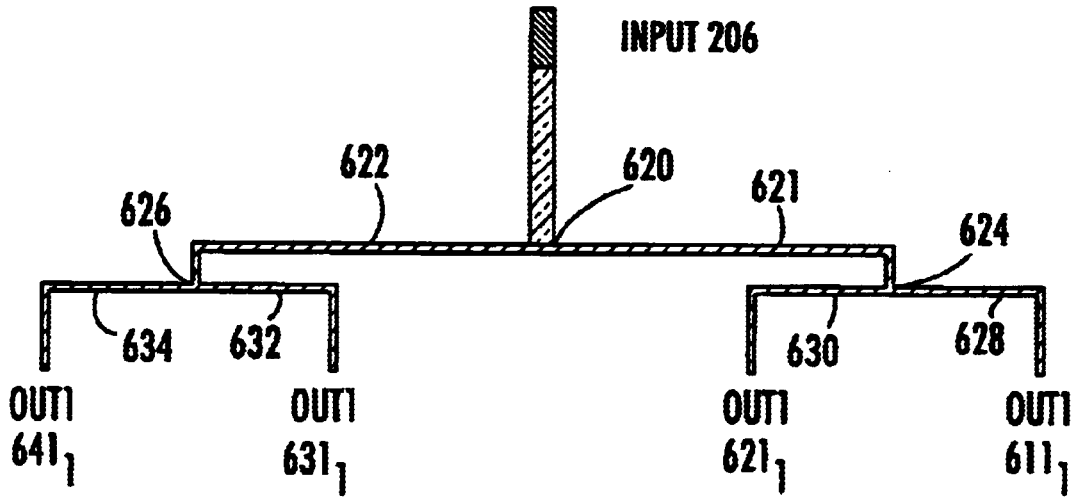
FIG. 6. PRIOR ART
FIG. 6 is a plan view of a prior art conductor layout for applying equal-amplitude and equal-phase signals from a common port to four individual ports.
Figure 7:
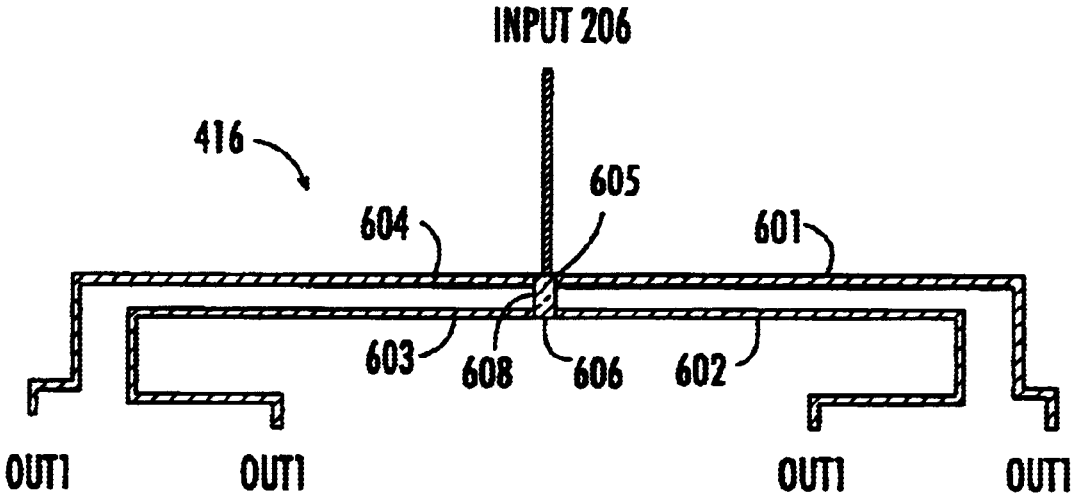
FIG. 7 is a plan view of a conductor layout according to an aspect of the invention for applying equal-amplitude and equal-phase signals from a common port to four individual ports.
Figure 9:
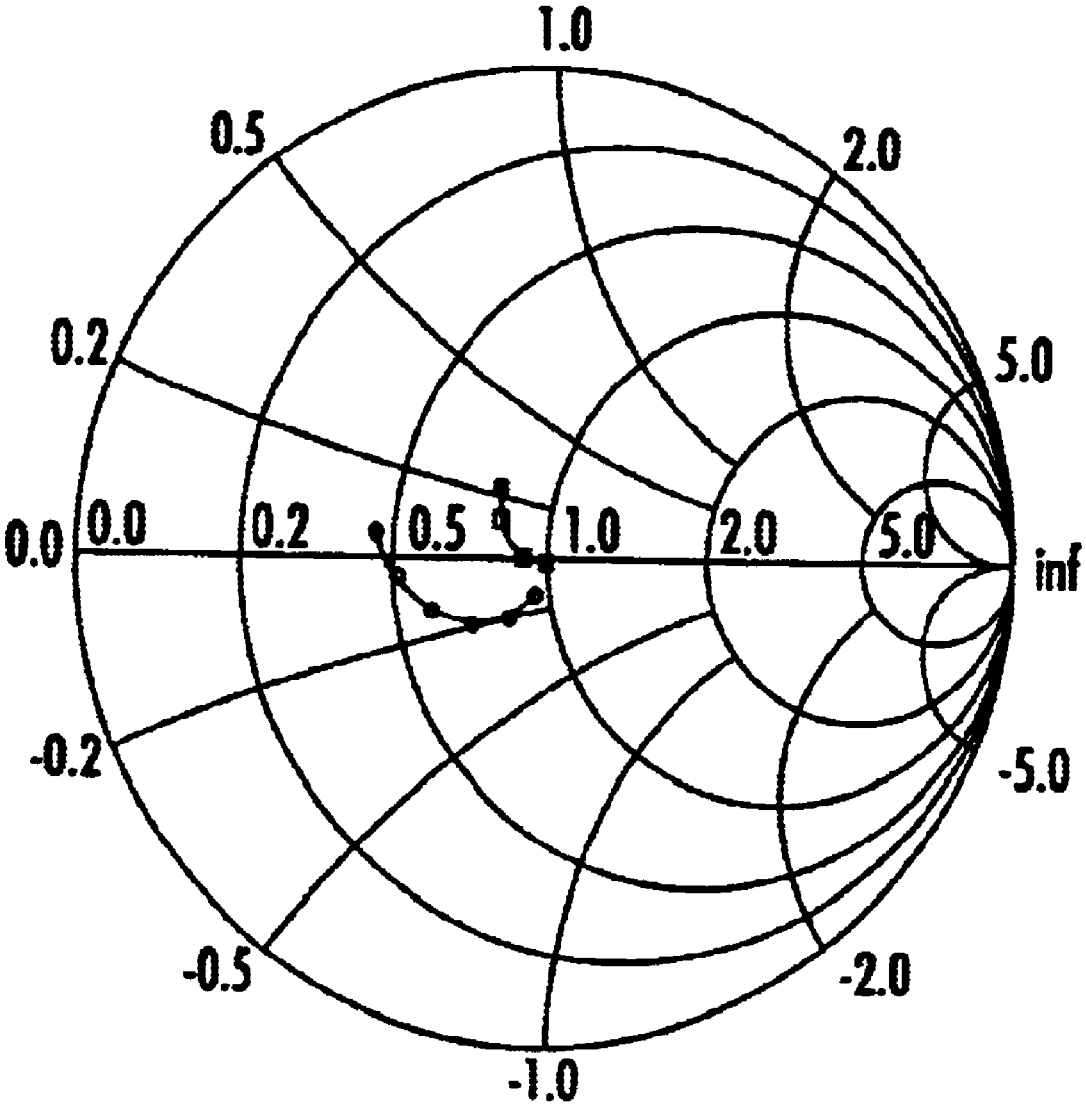
FIG. 9 is a Smith chart illustrating the impedance properties of the structures of FIGS. 6 and 7.

FIG. 6 is a plan view of a conductor layout used in the prior art to couple signal from a common port to four individual ports with equal amplitude and phase. FIG. 6 illustrates the conventional binary feed, with a first two-way split at 620, and equal-length conductors 621 and 622 leading from split 620 to further splits 624, 626. From split 624, two equal-length conductors 628, 630 lead to the output nodes or ports $\mathbf{611}_1$, $\mathbf{621}_1$, and from split 626, two equal-length conductors 632, 634 lead to the output nodes or ports $\mathbf{631}_1$, and $\mathbf{641}_1$. The arrangement of FIG. 7, according to an aspect of the invention, provides better performance. In FIG. 7, the input transmission line is equivalent to common port 206. The input transmission line ends at a junction 605, where a pair of equal-length transmission lines 601 and 604 join. A short bridge transmission line 603 couples juncture 605 to a further juncture 606. A further pair of transmission lines 602, 603 join at juncture 606. For reasons which are not clear, the performance of the structure of FIG. 7 is superior to that of the arrangement of FIG. 6. The improvement can be seen in the Smith plot of FIG. 9, where the plot represents impedance looking into the common port, with the four individual ports terminated in 200-ohm resistors. The impedance plot of the prior-art arrangement is indicated by circles, while the impedance plot of the arrangement of FIG. 7 is represented by squares. The locus of curve associated with the FIG. 6 arrangement art extends much farther from the center point 1 than does the locus of the arrangement according to FIG. 7. The Smith plot of FIG. 9 suggests that the FIG. 7 arrangement would have superior impedance match within the 4–20 GHz. bandwidth in a system having a characteristic impedance represented by unity (1.0) on the chart. It is believed that the improvement is a result of physically splitting (or combining) all four of the conductors at the "same" point, rather than distributing the splits over a large physical space. Thus, a "star" structure would presumably provide the best performance.

The arrangement according to this aspect of the invention allows easy calculation of the impedances of the sections of transmission line required to provide the impedance transformations required in a combiner/splitter, and the implementation of structures which tend to be much smaller than their equivalent actual transmission lines.

Figure 8:
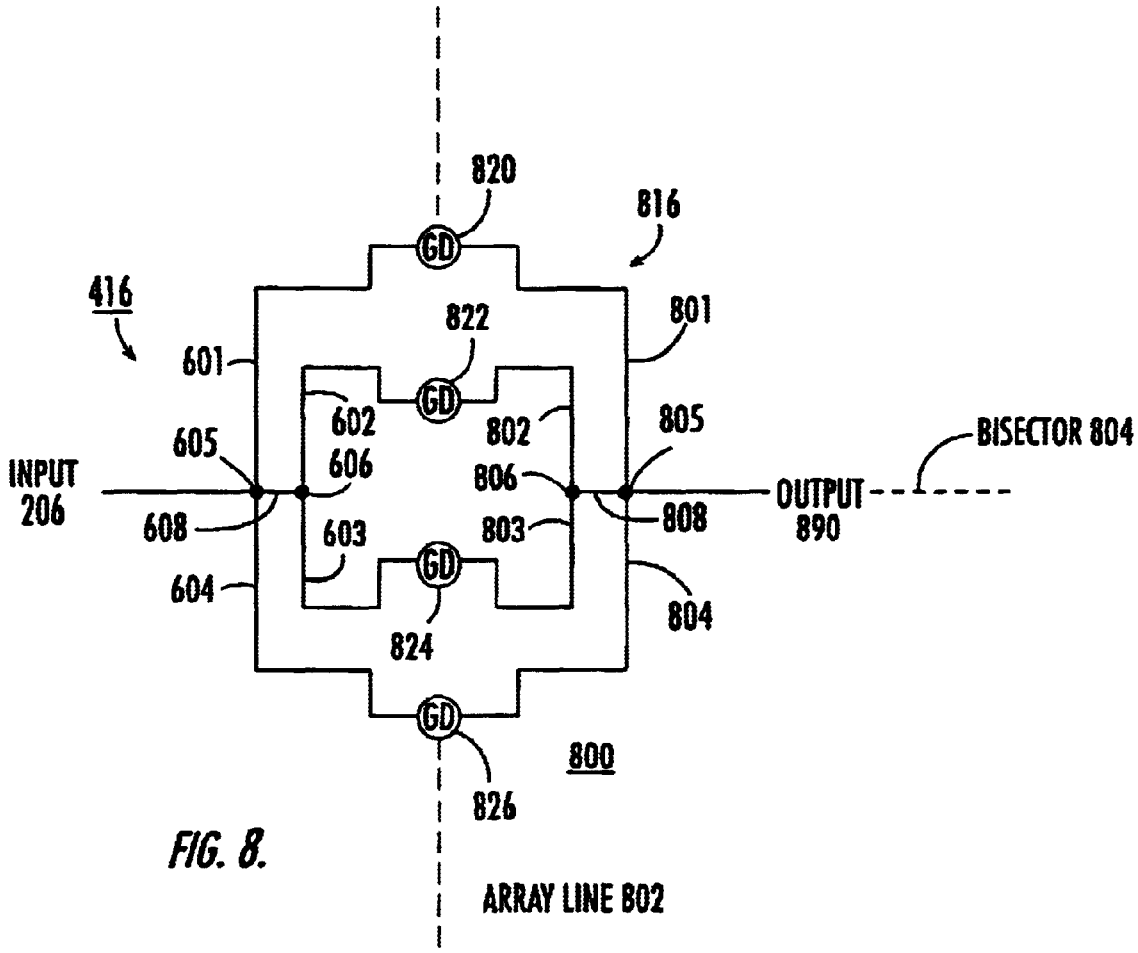
FIG. 8 is a simplified diagram in block and schematic form illustrating how the conductor layout of FIG. 7 can be used for paralleled amplifiers.

FIG. 8 is a simplified diagram illustrating the use of the arrangement 416 of FIG. 7 to directly drive the gates of paralleled FET amplifiers, and when used in reverse, for combining the outputs of the drains of the paralleled amplifiers. In FIG. 8, the input port 206 is at the left, and communicates at the junction 605 with strip conductor paths 601 and 602, and with bridge conductor 608. Bridge conductor 608, in turn, connects at a juncture 606 with strip conductor paths 602 and 603. The end of strip conduction path 601 of layout 416 remote from juncture 605 is connected to the gate (G) of a first field-effect transistor (FET) 820, and the end of strip conduction path 604 remote from juncture 605 is likewise connected to the gate of a FET 826. The end of strip conduction path 602 remote from juncture 606 is connected to the gate (G) of a third field-effect transistor (FET) 822, and the end of strip conduction path 603 remote from juncture 606 is likewise connected to the gate of a FET 824. A second conductor layout designated 816 is identical to that of layout 416, but is reversed left-to-right as seen in the illustration, so as to be connected for combining the output signals from the FETS 820, 822, 824, and 826. More particularly, The end of strip conduction path 801 of layout 816 remote from juncture 805 is connected to the drain (D) of first field-effect transistor (FET) 820, and the end of strip conduction path 804 remote from juncture 805 is likewise connected to the drain of FET 826. The end of strip conduction path 802 remote from juncture 806 is connected to the gate of third field-effect transistor 822, and the end of strip conduction path 803 remote from juncture 806 is likewise connected to the drain of FET 824. Details of other FET connections are not illustrated.

Other embodiments of the invention will be apparent to those skilled in the art. For example, in the arrangement of FIG. 2, each of artificial transmission line sections 212, 222, 232, and 242 could be replaced by a simple node connecting the first stage of artificial transmission line in each cascade directly to the last section of artificial transmission line, with the result that the intermediate transmission line sections 212, 222, 232, and 242 may be viewed as being a coupling arrangement. Naturally, such a coupling arrangement may include only one additional stage of coupling in each cascade as illustrated in FIG. 2, or each coupling arrangement may include plural stages of artificial transmission line. In some cases, it may be desirable to intermix artificial transmission lines with actual transmission lines, as the need may require.

Thus, a power splitter/combiner (200) according to an aspect of the invention, for dividing applied electromagnetic signals into plural substantially equal portions, includes a plurality (4 in FIG. 2), equal in number to the number (4) of the substantially equal portions, of cascades (201, 202, 203, 204) of artificial transmission line sections (211, 212, 213, 221, 222, 223, 231, 232, 233, 241, 242, 243). Each of the cascades (201, 202, 203, 204) includes an "input" port ($\mathbf{211}_1$, $\mathbf{221}_1$, $\mathbf{231}_1$, $\mathbf{241}_1$) and an "output" port (208*a*, 208*b*, 208*c*, 208*d*), with it being understood that the terms "input" and "output" are reversed when the splitter/combiner (200) is operating as a combiner. Each of the cascades (201, 202, 203, 204) also includes at least a first section (211, 221, 231, 241) of artificial transmission line coupled to its input port ($\mathbf{211}_1$, $\mathbf{221}_1$, $\mathbf{231}_1$, $\mathbf{241}_1$), and such a first section (211, 221, 231, 241) has a node ($\mathbf{211}_2$, $\mathbf{221}_2$, $\mathbf{231}_2$, $\mathbf{241}_2$) remote from the input port ($\mathbf{211}_1$, $\mathbf{221}_1$, $\mathbf{231}_1$, $\mathbf{241}_1$). Each of the cascades (201, 202, 203, 204) also includes a last section of artificial transmission line (213, 223, 233, 243) connected to the output port (208*a*, 208*b*, 208*c*, and 208*d*), which has a node ($\mathbf{213}_1$, $\mathbf{223}_1$, $\mathbf{233}_1$, $\mathbf{243}_1$) remote from the output port (208*a*, 208*b*, 208*c*, and 208*d*). Each of the cascades (201, 202, 203, 204) includes a further coupling arrangement (either a node $\mathbf{211}_2$/$\mathbf{213}_1$ such as 316 or additional stages 212, 222, 232, 242) coupling the node ($\mathbf{211}_2$, $\mathbf{221}_2$, $\mathbf{231}_2$, $\mathbf{241}_2$) of the first section (211) of artificial transmission line to the node ($\mathbf{213}_1$, $\mathbf{223}_1$, $\mathbf{233}_1$, $\mathbf{243}_1$) of the last section (213, 223, 233, 243) of artificial transmission line of that cascade. The further coupling arrangement may comprise one of (a) a simple connection of the node of the first section of artificial transmission line to the node of the last section of artificial transmission line, so that the cascade includes but two sections (211, 213, 221, 223, 231, 233, 241, 243) of artificial transmission line, and (b) at least an additional or further section (212, 222, 232, 242) of artificial transmission line including input and output nodes, where one of the nodes of the further artificial transmission line is connected to the node of the first section of artificial transmission line. An input coupling arrangement (416) is coupled to the input ports ($\mathbf{211}_1$, $\mathbf{221}_1$, $\mathbf{231}_1$, $\mathbf{241}_1$) of the plurality (4) of cascades (201, 202, 203, 204) of artificial transmission lines, for coupling the input ports of the plurality (4) of cascades (201, 202, 203, 204) in parallel to define a common port (206) (206) of the power splitter/combiner (200). The electromagnetic signals, if applied to the common port (206) of the power splitter/combiner (200), divide in accordance with the impedances presented by the input ports of the cascades (201, 202, 203, 204). Similarly, the individual electromagnetic signals from the cascades (201, 202, 203, 204), if combined at the common port (206) of the power splitter/combiner (200), combine in accordance with the impedances presented to the common port (206).

The power splitter/combiner (200) also includes a plurality, equal in number to the number (3) of stages of artificial transmission line cascaded in any one of the cascades (201, 202, 203, 204) of artificial transmission lines, of sets (250, 260, 270) of equal-valued isolation resistors. One of the sets (250, 260, 270) of equal-valued isolation resistors is coupled to the output ports (208*a*, 208*b*, 208*c*, and 208*d*) of the cascades (201, 202, 203, 204) and to a node (250', 260', 270') common to the one of the sets (250, 260, 270). One end of the resistors (251, 252, 253, 254, 261, 262, 263, 264, 271, 272, 273, 274) of each other set (250, 260, 270) of the plurality of sets of equal-valued isolation resistors are coupled to a node (250', 260', 270') common to that set. The other ends of the resistors (251, 252, 253, 254, 261, 262, 263, 264, 271, 272, 273, 274) of each other one (250, 260) of the sets (250, 260, 270) of equal-valued resistors are also coupled to the nodes of corresponding ones of the stages of the artificial transmission lines remote from the input port of that one of the cascades of artificial transmission lines in which the stages of the artificial transmission lines lie.

In a particularly advantageous manifestation of the invention, each of the stages of artificial transmission line includes at least first and second ($\mathbf{411}_1$, $\mathbf{411}_2$, $\mathbf{412}_1$, $\mathbf{412}_2$, $\mathbf{413}_1$, $\mathbf{413}_2$) planar spiral inductors overlying a ground plane (connected to 410*g*). The first and second planar spiral inductors are electrically coupled in series, which is to say with a first end of one of the first and second planar spiral inductors in electrical communication with the first end of the other one of the planar spiral inductors. The first and second spiral inductors and at least one of the stages of artificial transmission line of each cascade further includes first ($\mathbf{413}_3$), second ($\mathbf{413}_4$) and third ($\mathbf{413}_5$) discrete capacitors coupled to the ends of the spiral inductors ($\mathbf{413}_1$, $\mathbf{413}_2$). In a particular embodiment, each of the discrete capacitors is in the form of a capacitive metallization overlying the ground plane, and the splitter/combiner (200) includes four cascades (201, 202, 203, 204) of artificial transmission lines.

In a particular embodiment of the splitter/combiner (200), the input coupling arrangement (416) comprises a first pair (601, 604) of elongated transmission lines in the form of strip conductors overlying the ground plane, where each transmission line of the first pair (601, 604) of elongated transmission lines has a first predetermined length, and are coupled together at a first common node (605) for receiving the electromagnetic signal. The input coupling arrangement (416) also includes a second pair (602, 603) of elongated transmission lines, also in the form of strip conductors overlying the ground plane. Each transmission line of the second pair (602, 603) of elongated transmission lines has a second predetermined length different from the first predetermined length, and they are coupled together at a second common node (606). A transmission-line bridge (608) couples the first common node (605) of the first pair (601, 604) of transmission lines to the second common node (608) of the second pair (602, 603) of transmission lines, to thereby define the common port (206) of the splitter/combiner (200). Thus, electromagnetic energy applied to the common port (206) of the splitter/combiner (200) arrives at the first common node (605) and is also applied (by way of bridge 608) to the second common node (606).

In another avatar of the invention, a power splitter/combiner (200) for dividing applied electromagnetic signals into plural substantially equal portions, or for combining plural electromagnetic signals, comprises first, second, third and fourth cascades (201, 202, 203, 204) of artificial transmission lines or artificial transmission line segments or sections (211, 212, 213, 221, 222, 223, 231, 232, 233, 241, 242, 243). Each of the cascades (201, 202, 203, 204) of artificial transmission lines includes a cascade of first, second and third artificial transmission line sections (211, 212, 213, 221, 222, 223, 231, 232, 233, 241, 242, 243). Each of the artificial transmission line sections (211, 212, 213, 221, 222, 223, 231, 232, 233, 241, 242, 243) defines first and second nodes, and, within any one of the cascades (201, 202, 203, 204) of artificial transmission line sections (211, 212, 213, 221, 222, 223, 231, 232, 233, 241, 242, 243), the second node ($\mathbf{211}_2$) of the first artificial transmission line section (211) is connected to the first node ($\mathbf{212}_1$) of the second artificial transmission line section (212), and the second node ($\mathbf{212}_2$) of the second artificial transmission line section (212) is coupled to the first node ($\mathbf{213}_1$) of the third artificial transmission line section (213).

In this other avatar, a power coupling arrangement (416) includes a common port (206) for, in one mode of operation, receiving the electromagnetic signals, and routing divided electromagnetic signals with substantially equal amplitude and phase to the first nodes ($\mathbf{211}_1$, $\mathbf{221}_1$, $\mathbf{231}_1$, $\mathbf{241}_1$) of the first artificial transmission line sections (211, 221, 231, 241) of the first, second, third and fourth cascades (201, 202, 203, 204) of artificial transmission line sections (211, 212, 213, 221, 222, 223, 231, 232, 233, 241, 242, 243). Each of the first, second and third artificial transmission line sections (211, 212, 213, 221, 222, 223, 231, 232, 233, 241, 242, 243) of any one of the first, second, third and fourth cascades (201, 202, 203, 204) of artificial transmission line sections (211, 212, 213, 221, 222, 223, 231, 232, 233, 241, 242, 243) includes first and second planar, spiral conductors ($\mathbf{411}_1$, $\mathbf{411}_2$, $\mathbf{412}_1$, $\mathbf{412}_2$, $\mathbf{413}_1$, $\mathbf{413}_2$) overlying a ground plane (410*g*), with a second end of the first planar, spiral conductor of any one of the artificial transmission line sections (211, 212, 213, 221, 222, 223, 231, 232, 233, 241, 242, 243) connected to a first end of the second planar, spiral conductor of the one of the artificial transmission line sections (211, 212, 213, 221, 222, 223, 231, 232, 233, 241, 242, 243). As a result, a first end of the first planar, spiral conductor defines the first node of the one of the artificial transmission line segments, and a second end of the second planar, spiral conductor defines the second node of the one of the artificial transmission line segments.

This other avatar also includes first (250), second (260), and third (270) sets of isolation resistors, each containing four isolation resistors. Each of the isolation resistors (251, 252, 253, 254) of the first set (250) of isolation resistors has one end connected to a first common node (250'), and the other end connected to the second node ($\mathbf{211}_2$, $\mathbf{221}_2$, $\mathbf{231}_2$, $\mathbf{241}_2$) of one of the first artificial transmission line sections (211, 221, 231, 241) of the first, second, third and fourth cascades (201, 202, 203, 204) of artificial transmission line sections (211, 212, 213, 221, 222, 223, 231, 232, 233, 241, 242, 243). Each of the isolation resistors (261, 262, 263, 264) of the second set (260) of isolation resistors has one end connected to a second common node (260'), and the other end connected to the second node ($\mathbf{212}_2$, $\mathbf{222}_2$, $\mathbf{232}_2$, $\mathbf{242}_2$) of one of the second artificial transmission line sections (212, 222, 232, 242) of the first, second, third and fourth cascades (201, 202, 203, 204) of artificial transmission line sections (211, 212, 213, 221, 222, 223, 231, 232, 233, 241, 242, 243). Each of the isolation resistors (271, 272, 273, 274) of the third set (270) of isolation resistors has one end connected to a third common node (270'), and the other end connected to the second node ($\mathbf{213}_2$, $\mathbf{223}_2$, $\mathbf{233}_2$, $\mathbf{243}_2$) of one of the third artificial transmission line sections (213, 223, 233, 243) of the first, second, third and fourth cascades (201, 202, 203, 204) of artificial transmission line sections (211, 212, 213, 221, 222, 223, 231, 232, 233, 241, 242, 243). These resistors may be in the form of a resistive material overlying the ground plane.

A composite amplifier (10) according to another manifestation of the invention includes a first power splitter/combiner (200) including a common port (206) and a plurality (4) of individual ports. The first power splitter/combiner (200) has its common port (206) coupled to receive electromagnetic signals which are to be divided into substantially equal-amplitude portions, and generates substantially equal-amplitude signal portions at each of the individual ports of the first power splitter/combiner (200). The composite amplifier also includes a plurality (4) of amplifiers equal in number to the number of the plurality (4) of individual ports of the first power splitter/combiner (200). Each of the plurality of amplifiers including an output port, and also includes an input port coupled to a corresponding one of the individual ports of the first power splitter/combiner (200), for receiving at the input port of that amplifier one of the equal-amplitude signal portions. Each amplifier is for generating amplified signals at its output ports. A second power splitter/combiner (200) includes a common port (206) and the same plurality (4) of individual ports. The second power splitter/combiner (200) has each of its individual ports coupled to the output port of one of the amplifiers. The second power splitter/combiner (200) is for combining the amplified signals to produce combined amplified signals at the common port (206) of the second power splitter/combiner (200). At least one of the first and second power splitter/combiner (200)s includes (a) a plurality (4), equal in number to the plurality (4), of cascades (201, 202, 203, 204) of artificial transmission lines. Each of the cascades (201, 202, 203, 204) of artificial transmission lines includes an input port and an output port. Each of the cascades (201, 202, 203, 204) of artificial transmission lines also includes at least a first section of artificial transmission line coupled to the input port and has a node remote from the input port, and a last section of artificial transmission line connected to the output port and has a node remote from the output port. Each of the cascades (201, 202, 203, 204) of artificial transmission lines also includes a further coupling arrangement coupling the node of the first artificial transmission line to the node of the last artificial transmission lines. This further coupling arrangement may comprise one of (i) a simple connection of the node of the first section of artificial transmission line to the node of the last section of artificial transmission line and (ii) a further artificial transmission line including input and output nodes, one of which nodes of the further artificial transmission line is connected to the node of the first section of artificial transmission line. The one of the first and second power splitter/couplers also includes (b) an input coupling arrangement coupled to the input ports of the plurality (4) of cascades (201, 202, 203, 204) of artificial transmission lines, for coupling the input ports of the plurality (4) of cascades (201, 202, 203, 204) in parallel to define the common port (206) of the power splitter/combiner (200). Thus, electromagnetic signals, if applied to the common port (206) of the power splitter/combiner (200), divide in accordance with the impedances presented by the input ports of the cascades (201, 202, 203, 204). The one of the first and second power splitter/couplers also includes (c) a plurality, equal in number to the number of stages of artificial transmission line cascaded in any one of the cascades (201, 202, 203, 204) of artificial transmission lines, of sets of equal-valued isolation resistors. One of the sets of equal-valued isolation resistors is coupled to the output ports of the cascades (201, 202, 203, 204) and to a node common to the one of the sets. The resistors of other ones of the plurality of sets of equal-valued isolation resistors are coupled to a node common to the specific other one of the plurality of sets of equal-value isolation resistors, and to those nodes of stages of the artificial transmission lines remote from the input port of that one of the cascade of artificial transmission lines in which the stages of the artificial transmission lines lie. Each of the stages of artificial transmission line include at least first and second planar spiral inductors overlying a ground plane. The first and second planar spiral inductors are electrically coupled in series, and at least one of the artificial transmission lines further including first, second and third discrete capacitors coupled to the spiral inductors. Finally, the one of the splitter/combiner (200)s also includes a coupling arrangement for coupling the output port of each of the cascades (201, 202, 203, 204) of artificial transmission lines to one of the individual ports of the splitter/combiner (200).

In one version of this manifestation, at least some of the discrete capacitors are in the form of a capacitive metallization overlying the ground plane, and separated therefrom by a layer of dielectric material.

A composite amplifier (800) according to a particular manifestation of the invention includes a plurality (four) of amplifiers (820, 822, 824, 826), each having an input port (G) and an output port (D), the amplifiers being physically arrayed in a side-by-side line fashion (802) defining a bisector (804). A common input port (206, 605) is located on the bisector (804) of the line (802) of the array, on that (left) side of the array on which the input ports (G) of the amplifiers (820, 822, 824, 826) lie. A common output port (805, 890) is located on the bisector (804), on that (right) side of the array on which the output ports (D) of the amplifiers (820, 822, 824, 826) lie. A first conductor structure (416) includes elongated equal-length conductor strips (601, 602, 603, 604) connected to the input ports (D) of the amplifiers (820, 822, 824, 826) and to a common point (605, 606) adjacent the common input port (206, 605), and electrically connected to the common input port. A second conductor structure (816) includes elongated equal-length conductor strips (801, 802, 803, and 804) connected to the output ports (D) of the amplifiers and to a common point (805, 806) adjacent the common output port (805, 806, 890), and electrically connected to the common output port.

What is claimed is:

1. A power splitter/combiner for dividing applied electromagnetic signals into plural substantially equal portions, said power splitter/combiner comprising:

a plurality, equal in number to the number of said substantially equal portions, of cascades of artificial transmission lines, each of said cascades including an input port and an output port, and also including at least a first section of artificial transmission line coupled to said input port and having a node remote from said input port, and a last section of artificial transmission line connected to said output port and having a node remote from said output port, and further coupling means coupling said node of said first section of artificial transmission line to said node of said last artificial transmission lines, which further coupling means may comprise one of (a) a simple connection of said node of said first section of artificial transmission line to said node of said last section of artificial transmission line and (b) a further artificial transmission line including input and output nodes, one of which nodes of said further artificial transmission line is connected to said node of said first section of artificial transmission line;

input coupling means coupled to said input ports of said plurality of cascades of artificial transmission lines, for coupling said input ports of said plurality of cascades in parallel to define an input port of said power splitter/combiner, said electromagnetic signals, if applied to said input port of said power splitter/combiner, dividing in accordance with the impedances presented by said input ports of said cascades; and a plurality, equal in number to said number of stages of artificial transmission line cascaded in any one of said cascades of artificial transmission lines, of sets of equal-valued isolation resistors, one of said sets of equal-valued isolation resistors being coupled to said output ports of said cascades and to a node common to said one of said sets, the resistors of other ones of said plurality of sets of equal-valued isolation resistors being coupled to a node common to the specific other one of said plurality of sets of equal-value isolation resistors, and to those nodes of stages of said artificial transmission lines remote from said input port of that one of said cascade of artificial transmission lines in which said stages of said artificial transmission lines lie.

2. A power splitter/combiner according to claim 1, in which:

each of said stages of artificial transmission line includes at least first and second planar spiral inductors overlying a ground plane, said first and second planar spiral inductors being coupled in series, and at least one of said stages of artificial transmission line further including first, second and third discrete capacitors, each of said discrete capacitors being in the form of a capacitive metallization overlying said ground plane.

3. A power splitter/combiner according to claim 2, wherein said plurality equals four.

4. A power splitter/combiner according to claim 1, wherein said input coupling means comprises:

a first pair of elongated transmission lines in the form of strip conductors overlying said ground plane, each transmission line of said first pair of elongated transmission lines having a first predetermined length, and being coupled together at a first common node for receiving said electromagnetic signal; and a second pair of elongated transmission lines, also in the form of strip conductors overlying said ground plane, each transmission line of said second pair of elongated transmission lines having a second predetermined length different from said first predetermined length, and being coupled together at a second common node; and a transmission-line bridge coupling said first common node of said first pair of transmission lines to said second common node of said second pair of transmission lines, to thereby define said common port of said splitter/combiner, whereby electromagnetic energy applied to said first common node is also applied to said second common node.

5. A power splitter/combiner for dividing applied electromagnetic signals into plural substantially equal portions, or for combining individual electromagnetic signals, said power splitter/combiner comprising:

first, second, third and fourth cascades of artificial transmission line segments, each of said cascades of artificial transmission line segments including a cascade of first, second and third artificial transmission line segments, each of said artificial transmission line segments defining first and second nodes, and, within any one of said cascades of artificial transmission line segments, said second node of said first artificial transmission line segment being connected to said first node of said second artificial transmission line segment, said second node of said second artificial transmission line segment being coupled to said first node of said third artificial transmission line segment;

power coupling means including an input port for receiving said electromagnetic signals, and for routing said electromagnetic signals in substantially equal amplitude and phase to said first nodes of said first artificial transmission line segments of said first, second, third and fourth cascades of artificial transmission line segments; and wherein each of said first, second and third artificial transmission line segments of any one of said first, second, third and fourth cascades of artificial transmission line segments including first and second planar, spiral conductors overlying a ground plane, a second end of said first planar, spiral conductor of any one of said artificial transmission line segments being connected to a first end of said second planar, spiral conductor of said one of said artificial transmission line segments, whereby a first end of said first planar, spiral conductor defines said first node of said one of said artificial transmission line segments, and a second end of said second planar, spiral conductor defines said second node of said one of said artificial transmission line segments;

a first set of four isolation resistors, each of said isolation resistors of said first set of isolation resistors having one end connected to a first common node, and the other end connected to said second node of one of said first artificial transmission line segments of said first, second, third and fourth cascades of artificial transmission line segments;

a second set of four isolation resistors, each of said isolation resistors of said second set of isolation resistors having one end connected to a second common node, and the other end connected to said second node of one of said second artificial transmission line segments of said first, second, third and fourth cascades of artificial transmission line segments; and a third set of four isolation resistors, each of said isolation resistors of said third set of isolation resistors having one end connected to a third common node, and the other end connected to said second node of one of said third artificial transmission line segments of said first, second, third and fourth cascades of artificial transmission line segments.

6. A power splitter/combiner according to claim 5, wherein each of said resistors of said first, second, and third sets of isolation resistors is in the form of a resistive material overlying said ground plane.

7. A composite amplifier, comprising:

a first power splitter/combiner including a common port and a plurality of individual ports, said first power splitter/combiner having its common port coupled to receive electromagnetic signals to be divided into substantially equal-amplitude portions, for generating substantially equal-amplitude signal portions at each of said individual ports;

a plurality of amplifiers equal in number to the number of said plurality of individual ports, each of said plurality of amplifiers including an output port and an input port coupled to a corresponding one of said individual ports of said first power splitter/combiner, for receiving at said input port one of said equal-amplitude signal portions, for generating amplified signals at said output ports of said amplifiers;

a second power splitter/combiner including a common port and said plurality of individual ports, said second power splitter/combiner having each of its individual ports coupled to said output port of one of said amplifiers, for combining said amplified signals to produce combined amplified signals at said common port of said second power splitter/combiner;

at least one of said first and second power splitter/combiners including a plurality, equal in number to said plurality, of cascades of artificial transmission lines, each of said cascades including an input port and an output port, and also including at least a first section of artificial transmission line coupled to said input port and having a node remote from said input port, and a last section of artificial transmission line connected to said output port and having a node remote from said output port, and further coupling means coupling said node of said first section of artificial transmission line to said node of said last artificial transmission lines, which further coupling means may comprise one of (a) a simple connection of said node of said first section of artificial transmission line to said node of said last section of artificial transmission line and (b) a further artificial transmission line including input and output nodes, one of which nodes of said further artificial transmission line is connected to said node of said first section of artificial transmission line;

input coupling means coupled to said input ports of said plurality of cascades of artificial transmission lines, for coupling said input ports of said plurality of cascades in parallel to define said common port of said power splitter/combiner, said electromagnetic signals, if applied to said common port of said power splitter/combiner, dividing in accordance with the impedances presented by said input ports of said cascades;

a plurality, equal in number to said number of stages of artificial transmission line cascaded in any one of said cascades of artificial transmission lines, of sets of equal-valued isolation resistors, one of said sets of equal-valued isolation resistors being coupled to said output ports of said cascades and to a node common to said one of said sets, the resistors of other ones of said plurality of sets of equal-valued isolation resistors being coupled to a node common to the specific other one of said plurality of sets of equal-value isolation resistors, and to those nodes of stages of said artificial transmission lines remote from said input port of that one of said cascade of artificial transmission lines in which said stages of said artificial transmission lines lie;

coupling means for coupling said output port of each of said cascades of artificial transmission lines to one of said individual ports of said splitter/combiner.

8. A composite amplifier according to claim 7, wherein at least some of said plurality of cascades of artificial transmission lines include at least first and second planar spiral inductors overlying a ground plane, said first and second planar spiral inductors being coupled in series, and at least one of said stages of artificial transmission line further including first, second and third discrete capacitors coupled to said spiral inductors.

9. A composite amplifier according to claim 8, wherein at least some of said discrete capacitors are in the form of a capacitive metallization overlying said ground plane, and separated therefrom by a layer of dielectric material.

10. A composite amplifier, comprising:

a plurality of stages of artificial transmission line, each including discrete reactive elements;

a plurality of amplifiers, each having an input port and an output port, physically arrayed in a side-by-side line fashion, and each including a cascade of some of said stages of artificial transmission line coupled to its input port and a cascade of some of said stages of artificial transmission line coupled to its output port;

a common input port located on a bisector of the line of said array, on that side of said array on which said input ports of said amplifiers lie;

a common output port located on said bisector of said line of said array, on that side of said array on which said output ports of said amplifiers lie:

a first conductor structure including an elongated equal-length conductor strip connected to each of said cascades of stages of artificial transmission lines coupled to said input ports of said amplifiers and also connected to a common point adjacent said common input port, said first conductor structure being electrically connected to said common input port; and a second conductor structure including an elongated equal-length conductor strip coupled to each of said cascades of stages of artificial transmission lines coupled to said output ports of said amplifiers, and also connected to a common point adjacent said common output port, said second conductor structure being electrically connected to said common output port.

* * * * *